US009179751B2

(12) United States Patent
Lei et al.

(10) Patent No.: US 9,179,751 B2
(45) Date of Patent: Nov. 10, 2015

(54) ADJUSTABLE KEEPER DEVICE

(71) Applicants: Michael Lei, Danville, CA (US); Lisa Lei, Danville, CA (US)

(72) Inventors: Michael Lei, Danville, CA (US); Lisa Lei, Danville, CA (US)

(73) Assignee: Michael Lei, Danville, CA (US)

( * ) Notice: Subject to any disclaimer, the term of this patent is extended or adjusted under 35 U.S.C. 154(b) by 0 days.

(21) Appl. No.: 14/142,907

(22) Filed: Dec. 29, 2013

(65) Prior Publication Data

US 2015/0027479 A1 Jan. 29, 2015

Related U.S. Application Data

(60) Provisional application No. 61/859,287, filed on Jul. 28, 2013.

(51) Int. Cl.
*A45D 8/34* (2006.01)
*A45D 8/00* (2006.01)

(52) U.S. Cl.
CPC ..... *A45D 8/34* (2013.01); *A45D 2008/006* (2013.01)

(58) Field of Classification Search
CPC ..... A45D 8/00; A45D 8/14; A45D 8/16; A45D 8/36; A45D 2008/345; A45D 2008/006; A45F 2005/1013; A45F 2005/006; A45F 2005/008; B65D 63/10; B65D 63/1018; B65D 63/14; B65D 63/16; Y10T 24/3913; Y10T 24/3909; Y10T 24/3969; Y10T 24/3979; Y10T 24/3973; Y10T 24/3987; Y10T 24/3996
See application file for complete search history.

(56) References Cited

U.S. PATENT DOCUMENTS

| | | | | |
|---|---|---|---|---|
| 4,288,891 | A | 9/1981 | Boden | |
| 4,453,292 | A | 6/1984 | Bakker | |
| 4,878,269 | A | 11/1989 | Anscher et al. | |
| 5,345,657 | A | 9/1994 | Shimizu | |
| 5,365,641 | A | 11/1994 | Watanabe et al. | |
| 5,697,128 | A * | 12/1997 | Peregrine | 24/115 G |
| 5,778,904 | A * | 7/1998 | Elsner | 132/275 |
| 6,601,589 | B2 * | 8/2003 | Ericks | 132/273 |
| D551,067 | S | 9/2007 | Kawamura | |
| 8,424,169 | B2 | 4/2013 | Gammell et al. | |
| 2004/0040568 | A1 * | 3/2004 | Tsai | 132/275 |
| 2013/0185900 | A1 * | 7/2013 | Campbell | 24/301 |

FOREIGN PATENT DOCUMENTS

| | | | |
|---|---|---|---|
| EP | 0569226 | A1 | 11/1993 |
| EP | 0580343 | A1 | 1/1994 |
| EP | 1407682 | A1 | 4/2004 |

* cited by examiner

*Primary Examiner* — Rachel Steitz
(74) *Attorney, Agent, or Firm* — Carmen Ng

(57) ABSTRACT

Representative implementations of devices and techniques provide an adjustable keeper device for securing strands, such as strands of hair, for example. The keeper device includes one or more flexible guides for conducting a cord in a desired path. The flexible guides act as a conduit to route the cord and prevent strands from snagging with cord movement. The flexible guides and the cord are operable to secure the strands in a desired position. In some implementations, the keeper device includes an interchangeable vanity cover, removeably attached to the keeper device.

10 Claims, 8 Drawing Sheets

ADJUSTABLE KEEPER DEVICE

CROSS-REFERENCE TO RELATED APPLICATION

This application claims the benefit of U.S. provisional application No. 61/859,287 filed Jul. 28, 2013, the entire contents of which are incorporated herein by reference.

BACKGROUND

Holders of various designs and types may be used to organize or hold stranded or loose items, such as hair, filaments, strings, wires, and so forth. Common holders, such as elastic (rubber, for example) bands may be used to bundle and hold items, but they are generally not adjustable in size. Accordingly, it is desirable to keep various sizes on hand for various applications, which may not be convenient. Additionally, elastic bands can sometimes snag fine strands, causing tangles, pulling out hair, or at least causing some discomfort. Eventually, many elastic bands break or lose elasticity.

Other types of holders, such as clips may be more adjustable, or more capable of broader applications. Many clips, however, do not hold as well as elastic bands, allowing some strands to escape over time and with movement. Further, many clips also break or lose grip strength with repeated use.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

14, showing details of the example plunger implementation, in parallel to the keeper body.

Figure 16:
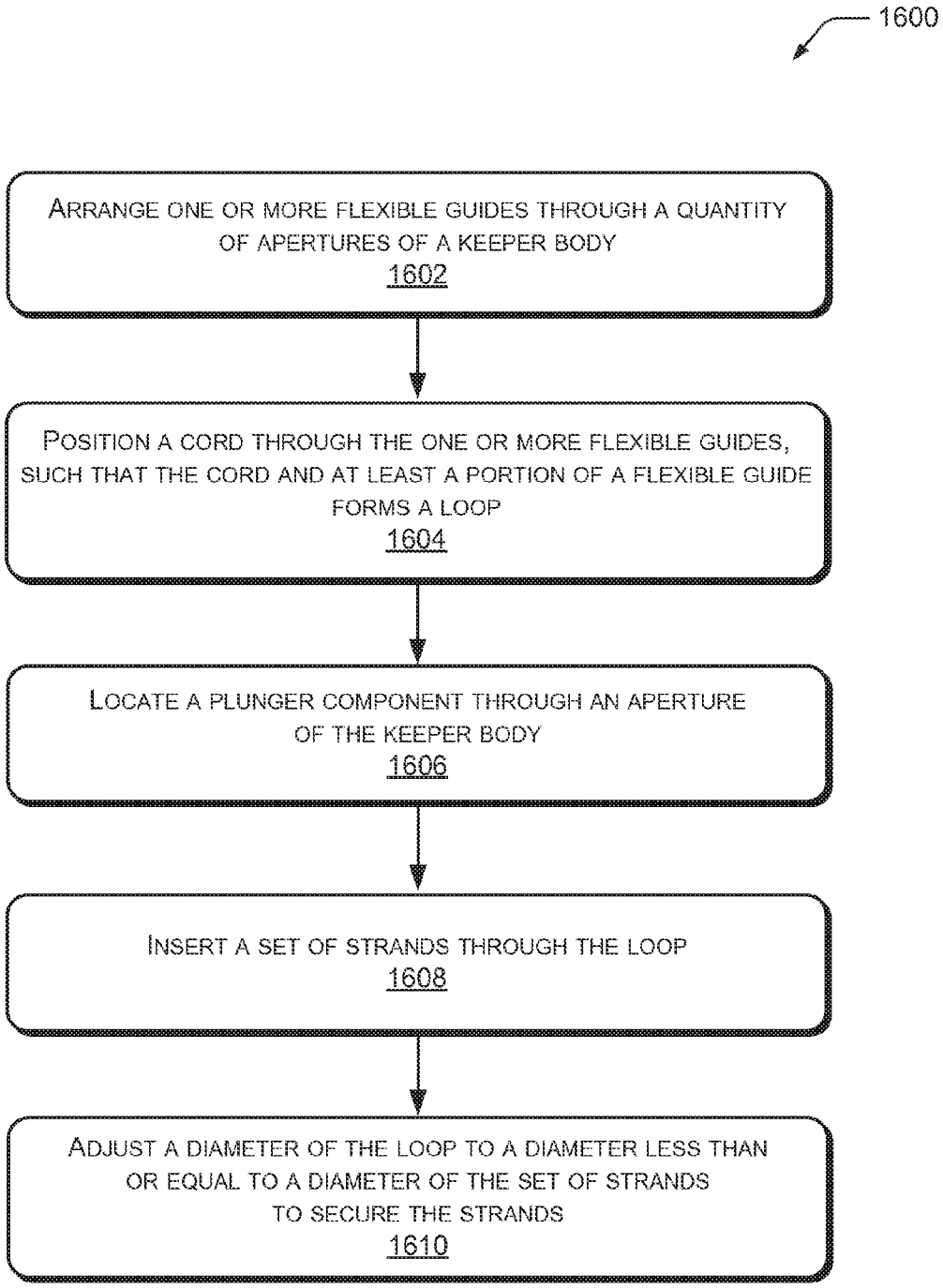

FIG. 16 is a flow diagram illustrating an example process of securing strands (such as hair, for example) with a keeper device.

DETAILED DESCRIPTION

Overview

Representative implementations of devices and techniques provide an adjustable keeper device for securing strands, such as strands of hair, for example. In an implementation, the keeper device includes one or more flexible guides for conducting a cord in a desired path. In the implementation, the flexible guides act as a conduit to route the cord and prevent strands from snagging with cord movement. The flexible guides and the cord are operable to secure the strands in a desired position. For example, in various implementations, the flexible guides and the cord form a loop that the strands may be inserted into or through. The loop may be adjusted, to tighten against the strands, holding the strands.

Various implementations of keeper devices include an actuator or plunger, which may be used to adjust the size of the loop, including reducing the diameter of the loop to tighten the loop for securing strands or increasing the diameter of the loop to release the strands. In some embodiments, the actuator may be oriented in a horizontal manner (i.e., parallel to the keeper body) and in other embodiments, the actuator may be oriented in a vertical manner (i.e., normal or perpendicular to the keeper body).

In some implementations, the keeper device includes an interchangeable vanity cover, removeably attached to the keeper device. For example, the vanity cover may be interchanged, by a user for instance, for a variety of decoration of the keeper device.

Various implementations of keeper devices and techniques are discussed in this disclosure. The keeper devices and techniques are discussed with reference to exemplary implementations illustrated in the figures. The keeper devices, keeper components, and techniques discussed herein may be referred to in the context of hair accessories, such as ponytail holders used for holding hair strands in a desired position, for ease of discussion and illustrative convenience. The keeper devices, keeper components, and/or techniques may also be used in other contexts, in other environments, with other implementations, and associated with other products, systems, and the like, to provide holding, securing, and/or organization of various stranded or loose items, products, and so forth.

Implementations are explained in detail below using a plurality of examples. Although various implementations and examples are discussed here and below, further implementations and examples may be possible by combining the features and elements of individual implementations and examples.

Example Embodiments

As shown in FIGS. 1-15, an example keeper device 100 may include a number of components. For example, as shown in the figures, a keeper 100 may include a keeper body 102, an actuator (e.g., plunger component) 104, one or more flexible guides 106, and a cord 108. In some implementations, the keeper 100 also includes an interchangeable vanity attachment ("vanity cover") 110, and may also include a cord cap 112. In various implementations, the keeper body 102 includes a cap portion 114 arranged to close the keeper body 102 and a quantity of apertures 116 for passing the cord 108 into and out of the body 102. In alternate embodiments, fewer, additional, or alternate components may be used to accomplish the techniques described herein.

In some embodiments, the components of a keeper 100 may be coupled together using various techniques including using threaded couplings, press-fit couplings, rib and groove couplings, sliding couplings, snap-fit couplings, and the like.

Further, in some implementations, two or more of the components may be glued together or fastened/coupled together in a similar manner so as to be permanently fixed. In other implementations, components may be configured to be temporarily fixed or removable as desired. Additionally, as will be described below, some components may be configured to have at least partial freedom of motion with respect to other components.

In various embodiments, the cord 108 is routed through the keeper body 102, via one or more apertures 116. For example, the keeper body 102 may include one or more cavities or chambers within that the cord 108 may be routed through. The cap portion 114 may also be arranged to form the chambers in conjunction with the keeper body 102. The cord 108 may be free to move within the chambers of the body 102, or it may be fixed in place, depending on the operational mode of the keeper 100.

In the various embodiments, the flexible guides 106 protrude through some of the apertures 116 of the keeper body 102. In the embodiments, the cord passes at least partly through the flexible guides 106, the flexible guides 106 acting like conduits for the cord 108. In the embodiments, the flexible guides 106 are arranged to conduct the cord 108 in a desired path from within the keeper body 102 to outside the keeper body 102. In an implementation, the flexible guides may also prevent strands from entering the keeper body 102 with movement of the cord 108, or prevent the cord from pinching strands, thus reducing or preventing "snagging" of the strands.

In various implementations, the cord and the flexible guides form a loop 120 outside of the body 102, arranged to hold a group of strands. For example, the strands may be inserted through the loop 120, and the combination of the cord 108 and the flexible guides 106 secure the group of strands in a desired position. In the various implementations, the size (e.g., diameter) of the loop 120 may be adjusted around the strands to hold the strands in place.

Figure 1:
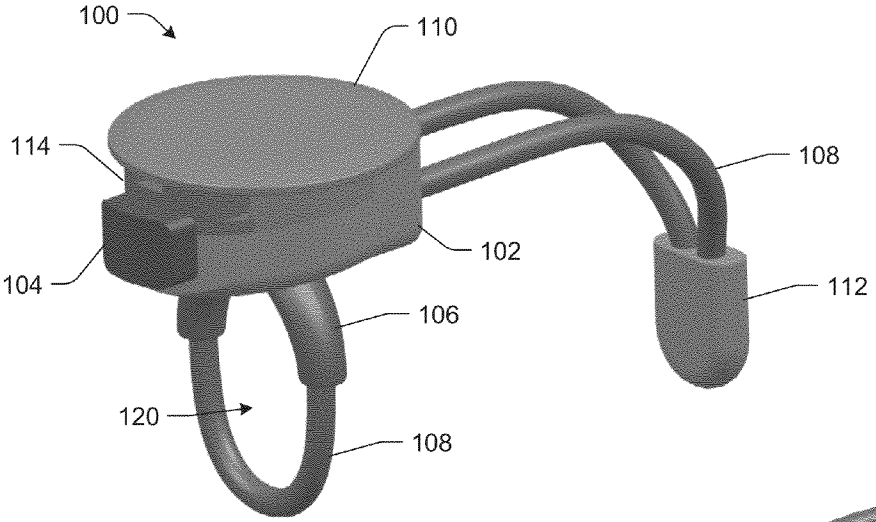
FIGS. 1 and 2 include two perspective views of an example keeper device, in which the techniques and devices in accordance with the present disclosure may be embodied.
Figure 2:
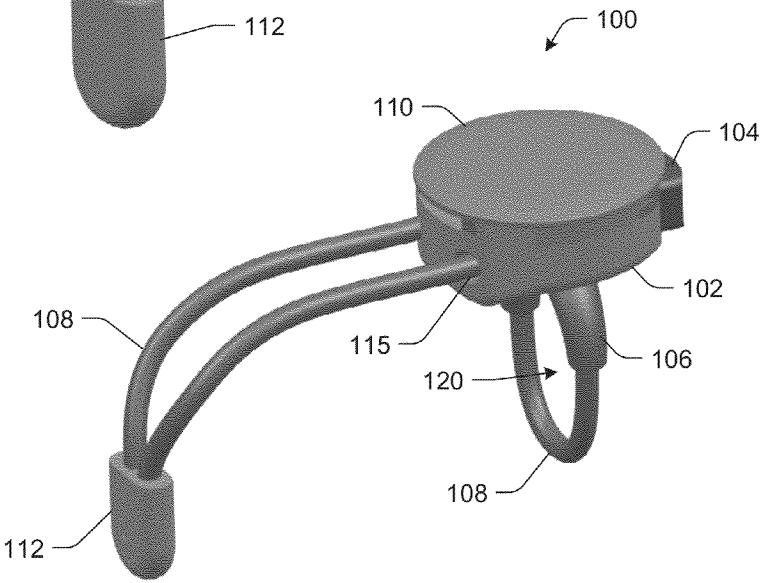
Figure 5:
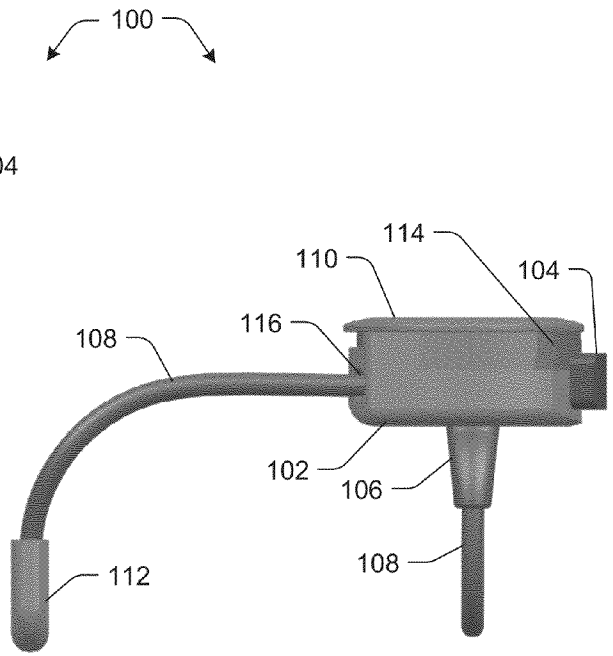
FIG. 5 shows a profile view of the example keeper device of FIG. 1.
Figure 3:
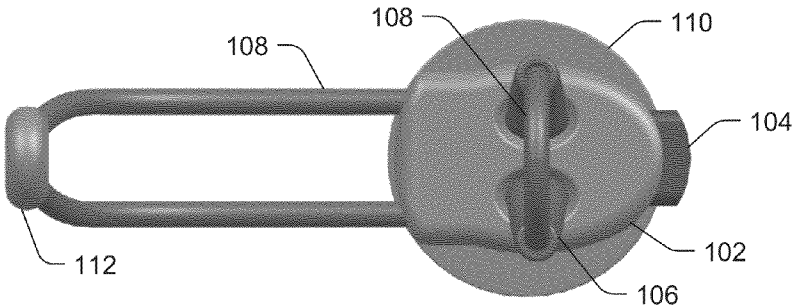
FIGS. 3 and 4 include top and bottom plan views respectively.
Figure 4:
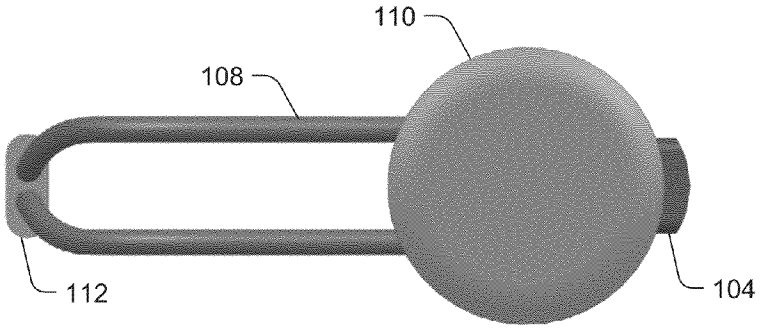
Figure 7:
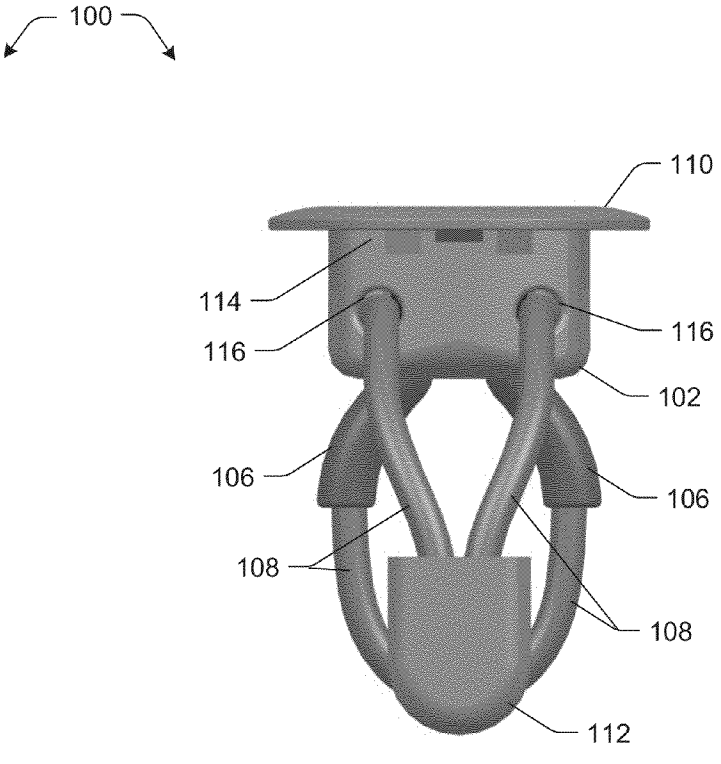
FIG. 6 shows a front view and FIG. 7 shows a back view of the example keeper device of FIG. 1.
Figure 6:
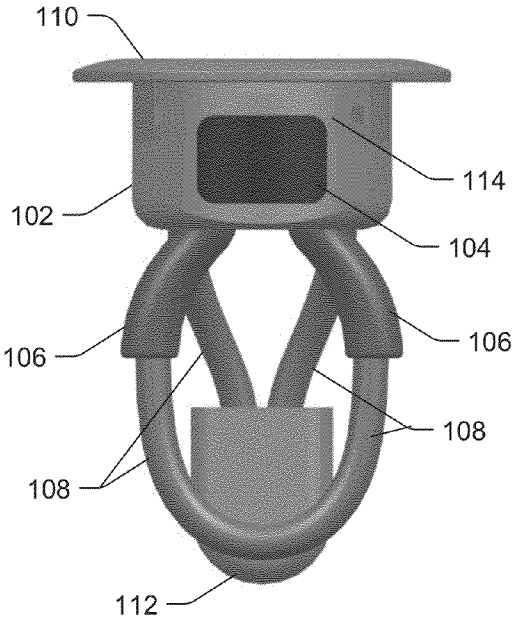
Figure 9:
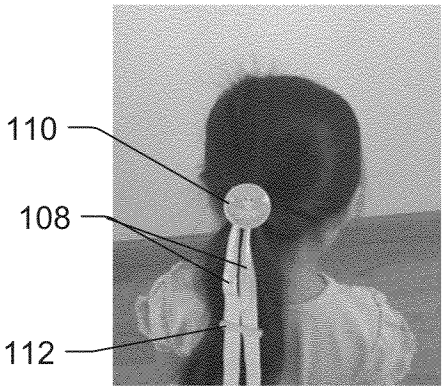
FIGS. 8 and 9 show two example embodiments of keeper devices, applied as hair holders. Two example cord types are shown in the illustrations.
Figure 8:
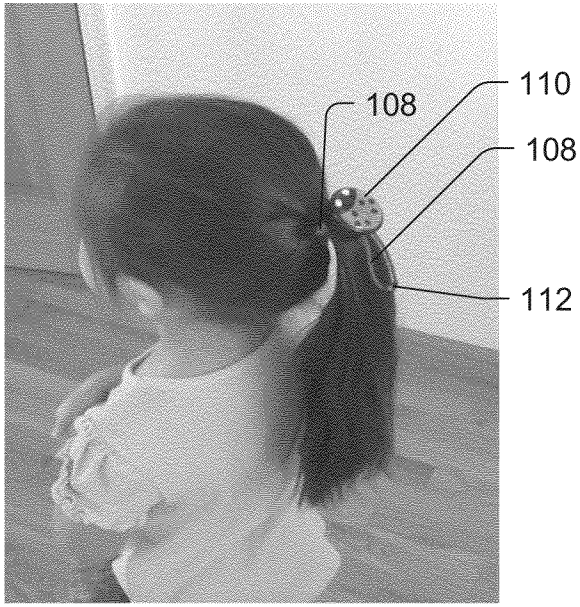

Illustrative examples of a keeper 100 holding a group of strands (e.g., hair) are shown in FIGS. 8 and 9. As shown in the figures, the hair may be inserted through the loop 120, and the loop 120 may be tightened around the hair, securing the hair in place. As shown in the examples of FIGS. 8 and 9, the cord 106 may comprise an elastic band, a ribbon, a textile cord, a flexible drawstring, or the like. Various materials may be used for the cord 108 based on desired properties (e.g., grip, texture, decoration, etc.).

In an implementation, multiple portions or ends of the cord 108 extend outside of the body 102. For example, a cord 108 may have two loose ends extending outside of the body 102 after routing the cord 108 through the body 102 and forming the loop 120. In various implementations, pulling on one or more of the loose cord 108 ends changes the diameter of the loop 120 (e.g., decreases the diameter, for example) based on a position of the plunger 104. In the implementations, with the plunger 104 activated, one or more of the loose cord 108 ends may be pulled after inserting strands through the loop 120, to tighten the loop 120 around the strands.

In one implementation, the multiple portions or ends of the cord 108 that extend outside of the body 102 may be temporarily or permanently joined. The two extending cord 108 portions may be joined, via a cord cap 112 or the like, such that the cord 108 becomes one continuous band. In another example, the end cap 112 may be positioned at another location along the extending cord 108 portions, some distance from the ends, as shown in FIG. 9. In such implementations, a single point on the cord 108, such as the cord cap 112, for example, may be pulled to pull both ends of the cord 108 at once.

As also shown in FIGS. 8 and 9 (as well as FIGS. 1-7), in an implementation, the keeper 100 may include a vanity cover 110 arranged to have one or more decorative features. The vanity cover 110 may be used to decorate the keeper 100, and to provide variety. For example, the vanity cover 110 may include designs, as shown in FIGS. 8 and 9, other types of decorations and adornments, and the like.

Figure 10:
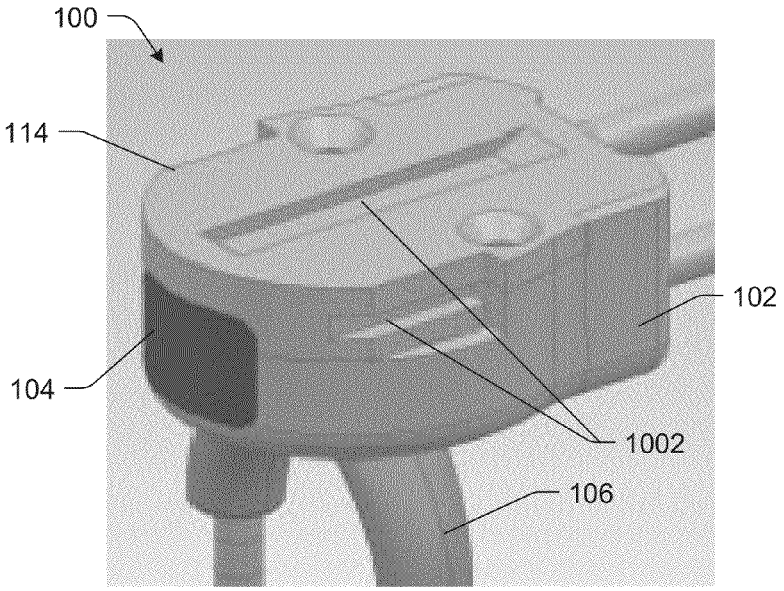
FIG. 10 is a perspective view of an example keeper device with an interchangeable vanity cover removed. Detail of example grooves for slideably coupling the vanity cover is shown.
Figure 11:
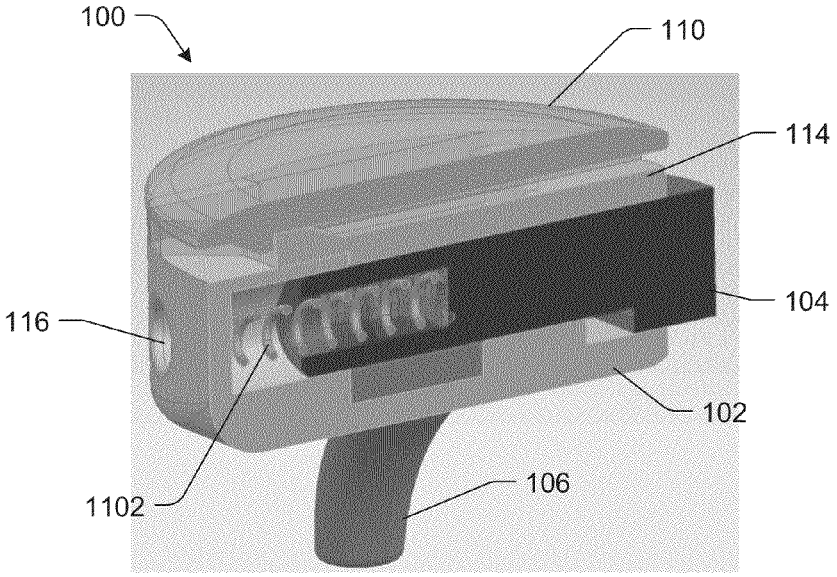
FIG. 11 is a cross-sectional view of an example keeper embodiment, showing one type of plunger, implemented in parallel to the keeper body.

In one implementation, the vanity cover 110 is removable and interchangeable, and may be removed and replaced (by a user, for instance) with like vanity covers 110 of different designs. In one implementation, the vanity cover 110 includes sliding components on one or more portions, and is slideably coupled to the keeper body 102. For example, as shown in FIG. 10, the cap portion 114 of the keeper body 102 may include one or more grooves 1002 for slideably coupling an interchangeable vanity attachment 110 to the keeper body 102. In another example, the keeper body 102 may include a locking mechanism portion (not shown) arranged to releaseably lock the interchangeable vanity attachment 110 to the keeper body 102.

In an example, the keeper 100 may be compatible with a plurality of other interchangeable vanity covers 110 with various decorative features, which may accompany the keeper 100, or may be available elsewhere. In the example, the other interchangeable vanity covers 110 may include compatible connectivity components, such as the slideable coupling components, for example, to allow them to be removeably coupled to the keeper 100 by a user as desired.

Referring to FIGS. 11-13 and 15, in an implementation, the plunger 104 is located at least partly within the keeper body 102 and interfaces with the keeper body 102, including any chambers, to fix a position of the cord 108 within the body 102 (or the chamber(s) of the body 102) in a first mode and to allow movement of the cord 108 within the body 102 or chamber(s) in a second mode.

Figure 12:
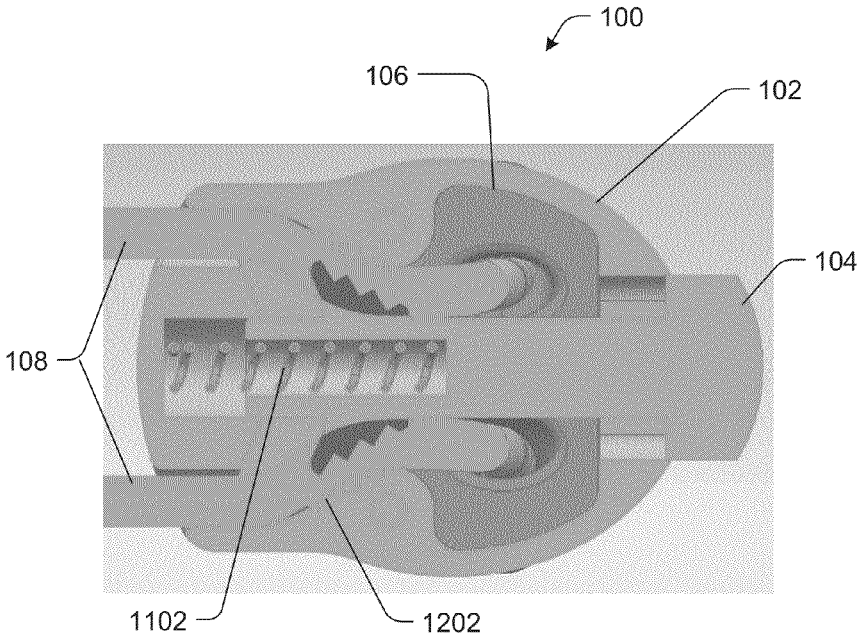
FIGS. 12 and 13 are cross-sectional views of the example keeper embodiment of FIG. 11, but cut along a plane of the keeper device. The illustrations show the example plunger implementation oriented in parallel to the keeper body, in two operational positions.

For example, FIG. 12 shows the plunger 104 in a first position, defining a first mode (at rest mode), where the plunger 104 is operable to maintain a position of the cord 108 relative to the keeper body 102. As shown in FIG. 12, the plunger 104 may be spring-loaded via a spring 1102, or a like component. In an implementation, the plunger 104 is arranged to grip (e.g., clamp, crimp, etc.) the cord 108, in conjunction with the body 102 (including any chambers), to prevent the cord from moving, while in the first mode.

Figure 13:
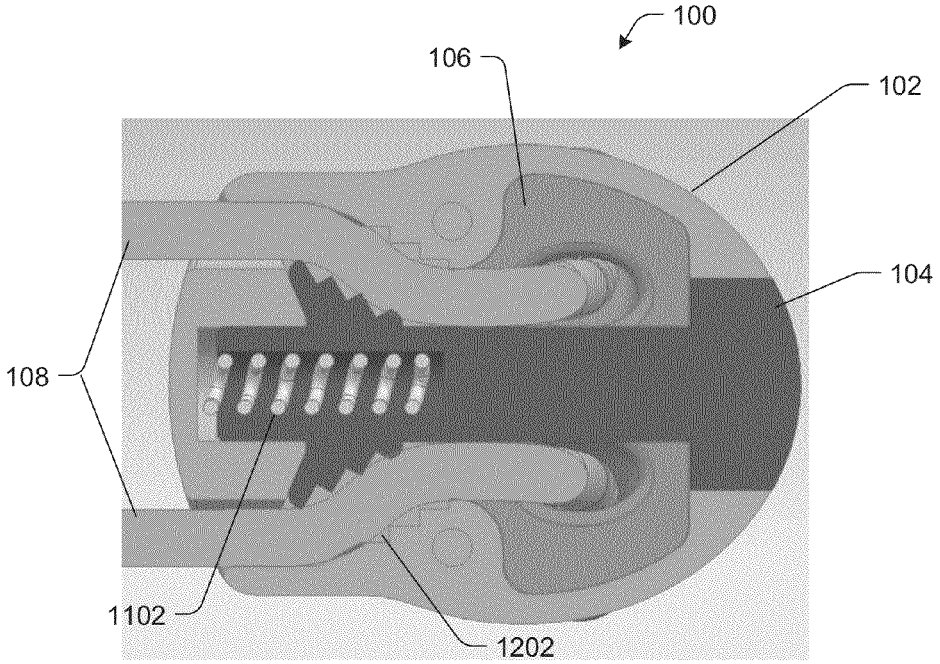

Additionally, FIG. 13 shows the plunger 104 in a second position, defining a second mode (active mode), where the plunger 104 is operable to allow the cord 108 to change position relative to the keeper body 102. As shown in FIG. 13, when the plunger 104 is activated (e.g., depressed into the body 102) the spring 1102 is compressed, and the plunger 104 surface is withdrawn from the cord 108. In an implementation, the plunger 104 is arranged, in conjunction with the body 102 (including any chambers) to allow movement of the cord 108 within the chamber while in the second mode.

In one implementation, the diameter of the loop 120 is fixed while the plunger 104 is in the first position, and the diameter of the loop 120 is adjustable while the plunger 104 is in the second position. In an alternate implementation, the diameter of the loop 120 may be decreased but not increased while the plunger 104 is in the first position and the loop 120 is fully adjustable (the diameter may be increased or decreased) while the plunger 104 is in the second position. In an example, the plunger 104 and/or the body 102 (including any chambers) may include one or more features 1202 (e.g., teeth, grooves, ridges, etc.) allowing one-way movement of the cord 108 while the plunger 104 is in the first position. For example, the features 1202 may be formed to allow the cord 108 to move in a direction that reduces the diameter of the loop 120, but not allow the cord 108 to move in a direction that increases the diameter of the loop 120.

In some implementations, as shown in FIGS. 1-7 and 11-13, the plunger component 104 is aligned and arranged to be operable in an orientation parallel to a longitudinal axis of the keeper body 102, while the loop 120 is arranged normal to the longitudinal axis of the keeper body 102 and the strands are secured parallel to the longitudinal axis of the keeper body. The longitudinal axis of the keeper body is defined as the longest axis in the plane of the keeper body 102.

Figure 14:
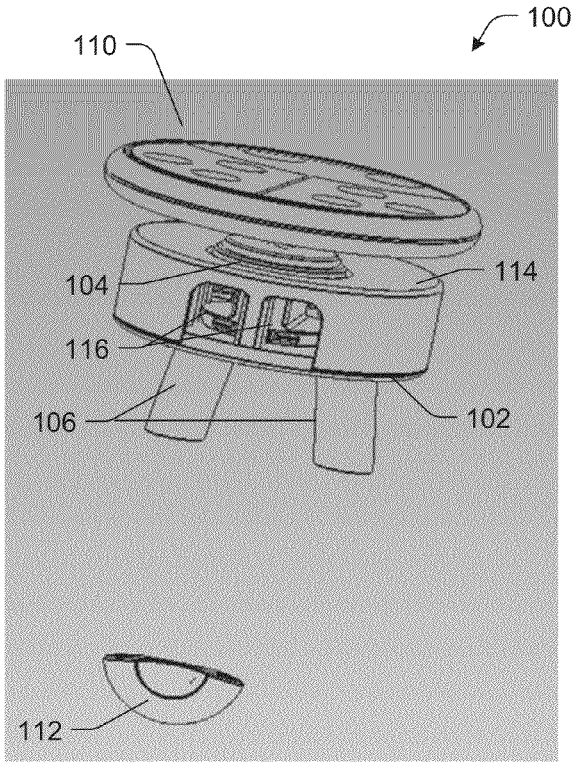
FIG. 14 includes a perspective view of another keeper device embodiment, having another type of plunger, implemented normal (perpendicular) to the keeper body.
Figure 15:
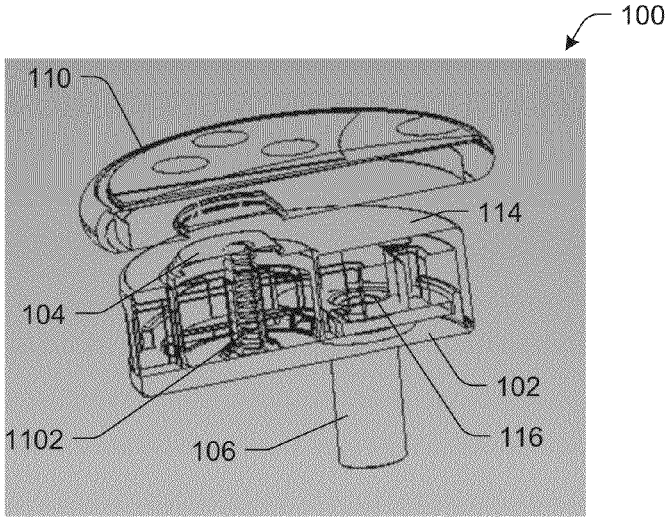
FIG. 15 is a cross-sectional view of the example keeper embodiment of FIG.

In other implementations, as shown in FIGS. 14 and 15, the plunger component 104 is aligned and arranged to be operable in an orientation normal (i.e., perpendicular) to the longitudinal axis of the keeper body 102 while the loop 120 is arranged normal to the longitudinal axis of the keeper body 102 and the strands are secured parallel to the longitudinal axis of the keeper body 102.

Illustrative Process

FIG. 16 is a flow diagram illustrating an example process 1600 of securing strands (such as hair, for example) with a keeper device (such as keeper 100, for example). The process 1600 describes using flexible guides (such as flexible guides 106, for example) to guide a cord in a desired path. In an implementation, the process includes forming a loop (such as loop 120, for example) for securing the strands with the flexible guides and a cord (such as cord 108, for example), where the loop is adjustable. The process 1600 is described with reference to FIGS. 1-15.

The order in which the process is described is not intended to be construed as a limitation, and any number of the described process blocks can be combined in any order to implement the process, or alternate processes. Additionally, individual blocks may be deleted from the process without departing from the spirit and scope of the subject matter described herein. Furthermore, the process can be implemented with any suitable components, or combinations thereof, without departing from the scope of the subject matter described herein.

At block 1602, the process includes arranging one or more flexible guides through a quantity of apertures of a keeper body (such as keeper body 102, for example). At block 1604, the process includes positioning a cord through the one or more flexible guides, such that the cord and at least a portion of a flexible guide forms a loop. In an implementation, the process includes positioning the cord such that the loop is substantially normal to the keeper body and the strands are secured substantially parallel to the keeper body.

At block 1606, the process includes locating a plunger component through an aperture of the keeper body, such that the plunger component is operational to maintain a position of the cord relative to the keeper body while the plunger is in a first position and is operational to allow the cord to change position relative to the keeper body while the plunger is in a second position. In one implementation, the first position is a rest position, with the plunger directly or indirectly holding the cord, not allowing it to move. For example, the holding may include compressing, deforming, gripping, crimping, pinching, clamping, etc. the cord within the keeper body (or chamber(s) of the keeper body) while the plunger is in the first position.

At block 1608, the process includes inserting a set of strands through the loop. For example, the strands may comprise a group of human hair, or like filaments.

At block 1610, the process includes adjusting a diameter of the loop to a diameter that is less than or equal to a diameter of the set of strands, to secure the strands. For example, the adjusting may be performed via arranging a portion of the cord through one or more other apertures of the keeper body such that changing a position of the portion of the cord (e.g., the portion(s) of cord that extend from the body 102) changes the diameter of the loop while the plunger is in the second position. In an implementation, the process includes depressing the plunger into the second position, pulling the portion of the cord to reduce a diameter of the loop, and releasing the plunger into the first position to secure the strands with the loop.

In an alternate implementation, the process includes reducing the diameter of the loop, to secure the strands for example, while the plunger remains in the first position. In the implementation, the process includes pulling the portion of the cord to reduce the diameter of the loop (after inserting the strands through the loop, for example) without depressing the plunger. In such an implementation, the plunger and/or portions of the body (or any chambers) may be designed so that the cord may be moved in one direction relative to the keeper body (to tighten the loop, for example) but not moved in the other direction, while the plunger is in the first position.

In an implementation, the process includes joining multiple ends of the portion of the cord, using a cord cap or the like, such that pulling the portion of the cord at a single location changes a position of the multiple ends of the portion of the cord. In other words, the multiple extending ends of the cord may be pulled together from a single joined point.

In various implementations, the process includes slideably coupling an interchangeable vanity cover to the keeper body. For example, the process may include selecting the interchangeable vanity cover from an assortment of interchangeable vanity covers having various designs. In one embodiment, the process includes releaseably locking the interchangeable vanity cover to the keeper body, to keep it in place.

In some implementations, the process includes exchanging the interchangeable vanity cover for a different interchangeable vanity cover by slideably releasing the interchangeable vanity cover from the keeper body and slideably coupling the different interchangeable vanity cover to the keeper body. For example, a user may exchange the interchangeable vanity cover for a different interchangeable vanity cover as desired.

In alternate implementations, other techniques may be included in the process in various combinations, and remain within the scope of the disclosure.

Conclusion

Although the implementations of the disclosure have been described in language specific to structural features and/or methodological acts, it is to be understood that the implementations are not necessarily limited to the specific features or acts described. Rather, the specific features and acts are disclosed as representative forms of implementing the invention.

What is claimed is:

1. An adjustable keeper, comprising:

a keeper body having one or more chambers, at least one of the chambers arranged to fix a position of a cord within the chamber in a first mode and to allow movement of the cord within the chamber in a second mode;

a cap portion arranged to close the keeper body and to form the one or more chambers in conjunction with the keeper body;

an actuator component located at least partly within the keeper body and arranged to determine whether the adjustable keeper in is the first mode or in the second mode, based on a position of the actuator component; and one or more flexible guides protruding through apertures of the keeper body, the one or more flexible guides conduct the cord in a desired path from within the keeper body to outside the keeper body and prevent hair strands from entering the keeper body with movement of the cord, wherein the cord passes at least partly through the one or more flexible guides, the cord and the one or more flexible guides forming a loop arranged to secure a group of hair strands in a desired position while the adjustable keeper is in the first mode, a diameter of the loop being adjustable while the adjustable keeper is in the second mode.

2. The adjustable keeper of claim 1, further comprising an interchangeable vanity cover slideably coupled to the cap portion, the interchangeable vanity cover having one or more slide components and one or more decorative features.

3. A device, comprising:

a keeper body having a quantity of apertures;

a plunger component located at least partly within the keeper body and operable to maintain a position of a cord relative to the keeper body while the plunger is in a first position and to allow the cord to change position relative to the keeper body while the plunger is in a second position; and one or more flexible guides protruding through apertures of the keeper body, the one or more flexible guides conduct the cord in a desired path from within the keeper body to outside the keeper body and prevent strands from entering the keeper body with movement of the cord, wherein the cord passes at least partly through the one or more flexible guides, the cord and the one or more flexible guides forming a loop arranged to secure a group of strands in a desired position while the plunger is in the first position.

4. The device in claim 3, further comprising a cap portion of the keeper body having one or more grooves for slideably coupling an interchangeable vanity attachment to the keeper body.

5. The device of claim 4, further comprising a locking mechanism portion of the keeper body arranged to releaseably lock the interchangeable vanity attachment to the keeper body.

6. The device of claim 3, further comprising an interchangeable vanity attachment removeably couple to the keeper body and having one or more decorative features.

7. The device of claim 6, further comprising a plurality of other interchangeable vanity attachments, each having a slideable coupling component and various decorative features and each arranged to be interchanged with the interchangeable vanity attachment by a use as desired.

8. The device of claim 3, wherein the plunger component is aligned and arranged to be operable in an orientation substantially normal to a longitudinal axis of the keeper body while the loop is arranged substantially normal to the longitudinal axis of the keeper body and the strands are secured substantially parallel to the longitudinal axis of the keeper body.

9. The device of claim 3, wherein the plunger component is aligned and arranged to be operable in an orientation substantially parallel to a longitudinal axis of the keeper body while the loop is arranged substantially normal to the longitudinal axis of the keeper body and the strands are secured substantially parallel to the longitudinal axis of the keeper body.

10. The device of claim 3, wherein the cord comprises one of an elastic band, a ribbon, a textile cord, or a flexible drawstring.

* * * * *